US006685308B2

(12) United States Patent
Yoshida et al.

(10) Patent No.: US 6,685,308 B2
(45) Date of Patent: Feb. 3, 2004

(54) IMAGE FORMING APPARATUS

(75) Inventors: Masahito Yoshida, Saitama (JP); Hiroyuki Inoue, Kanagawa (JP); Takashi Nojima, Tokyo (JP); Shusuke Inamura, Tokyo (JP); Yasufumi Tanaami, Tokyo (JP); Takeshi Iwasaki, Kanagawa (JP); Noriko Sato, Kanagawa (JP); Yasuyuki Hirai, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/224,653

(22) Filed: Aug. 21, 2002

(65) Prior Publication Data

US 2003/0063167 A1 Apr. 3, 2003

(30) Foreign Application Priority Data

Aug. 22, 2001 (JP) ..... 2001-251485

(51) Int. Cl.[7] ..... B41J 2/175
(52) U.S. Cl. ..... 347/85
(58) Field of Search ..... 347/5, 7, 14, 84, 347/85, 86, 87; 399/53, 57, 237

(56) References Cited

U.S. PATENT DOCUMENTS 5,136,305 A * 8/1992 Ims ..... 347/85
5,559,587 A * 9/1996 Ogata et al. ..... 355/246
5,650,811 A * 7/1997 Seccombe et al. ..... 347/85
5,757,390 A * 5/1998 Gragg et al. ..... 347/7
5,880,748 A * 3/1999 Childers et al. ..... 347/6

* cited by examiner

*Primary Examiner*—Anh T. N. Vo
(74) *Attorney, Agent, or Firm*—Fitzpatrick, Cella, Harper & Scinto

(57) ABSTRACT

The present invention provides an image forming apparatus for forming an image by discharging liquid from a recording head onto a recording medium, comprising a carriage to which the recording head and a sub-tank for storing the liquid to be supplied to the recording head are mounted and which can be shifted reciprocally, a main tank disposed out of the carriage and adapted to store the liquid, a liquid flow passage connected between the main tank and the sub-tank in order to supply the liquid from the main tank to the sub-tank, a flow passage opening/closing valve disposed in the liquid flow passage on the way and adapted to open and close the liquid flow passage, and control means for controlling opening/closing of the flow passage opening/closing valve in accordance with an image forming condition during image formation using the recording head.

9 Claims, 7 Drawing Sheets

IMAGE FORMING APPARATUS

BACKGROUND OF THE INVENTION

1. Field of the Invention

The present invention relates to an image forming apparatus for forming an image by discharging liquid from a liquid discharge head onto a recording medium.

2. Description of Related Art

In conventional general image forming apparatus, an image is formed on a recording medium by discharging liquid such as ink and treatment liquid for adjusting a fixing ability of the ink from discharge ports of a liquid discharge head disposed in a spaced apart relationship from a surface of the recording medium by a proper distance. An ink tank for containing the ink to be discharged is provided on a carriage together with the liquid discharge head or is disposed out of the carriage.

FIG. 5 is a view showing a schematic construction of an image forming apparatus in which the ink tank is provided on the carriage.

A carriage 101 on which a liquid discharge head (not shown) for forming an image by discharging liquid such as ink onto a recording medium 102 and an ink tank (not shown) for storing the ink to be supplied to the head are mounted is secured to a part of a belt 104 mounted between and wound around two pulleys 106*a* and 106*b*. The belt 104 is shifted by rotatingly driving one 106*a* of the pulleys reversibly by means of a motor 107, with the result that the carriage 101 is reciprocally shifted in directions A along a shaft 103. A signal and an electric power for causing the liquid discharge head to discharge the ink are inputted from control means (not shown) of the image forming apparatus via a cable 105.

Further, the image forming apparatus is provided with convey means (not shown) for conveying the recording medium 102 in a direction B, and the image is formed on the entire recording medium 102 by repeating a conveying operation for the recording medium 102 effected by the convey means and an image forming operation effected by the liquid discharge head mounted on the carriage reciprocally shifting with respect to the recording medium 102.

The ink tank can be exchanged with respect to the carriage 101 in accordance with consumption of the ink or new ink can be replenished into the ink tank. Depending upon kind of device of the image forming apparatus, a head cartridge in which an ink tank and a liquid discharge head are integrally formed is used so that the ink tank and the head can be exchanged integrally or collectively. In this type, since an ink storing amount is determined by a dimension of the carriage 101, it is disadvantageous when a large amount of ink is consumed.

FIG. 6 is a view showing a schematic construction of an image forming apparatus in which the ink tank is disposed out of the carriage.

An operation of the carriage 101 in the image forming apparatus shown in FIG. 6 is substantially the same as that of the carriage shown in FIG. 5. However, the image forming apparatus shown in FIG. 6 is designed so that the ink is supplied to a sub-tank 109 (refer to FIG. 7) on the carriage 101 through a tube 108 from a main tank 106 disposed out of the carriage 101.

FIG. 7 is a sectional view showing an internal construction of the carriage shown in FIG. 6.

The sub-tank 109 for storing a small amount of ink is mounted on the carriage 101, and ink flow passages are communicated from the sub-tank 109 to nozzles 110 of a liquid discharge head. The sub-tank 109 also acts as a buffer for replenishing new ink from the main tank 106 (FIG. 6) and for collecting a bubble generated in the flow passage.

As such, by designing so that the main tank 106 is disposed out of the carriage 101 and the ink is supplied to the sub-tank 109 on the carriage 101 through the tube 108, limitation regarding the dimension of the ink tank occupying the space on the carriage 101 is relaxed and, thus, the ink reserving amount of the entire apparatus can be increased. Therefore, recording regarding a recording medium 102 having a large size and recording regarding a large number of recording media 102 become possible.

However, when the ink is supplied from the main tank 106 disposed out of the carriage 101 to the liquid discharge head through the tube 108 during the recording operation, there arises a problem that pressure of the ink within the sub-tank 109 is greatly changed to affect an influence upon a discharging ability of the liquid discharge head, thereby worsening appearance quality of a recorded image. In general, it is preferable that the pressure within the sub-tank 109 is within a proper negative pressure range for balancing with discharge energy of the liquid discharge head. If the pressure is increased above such a proper range, i.e., if the pressure becomes near a positive pressure condition or it attains a positive pressure, the ink is apt to be dropped from the nozzles 110. On the other hand, if the pressure is decreased below such a proper range, i.e., if the negative pressure is further increased, the ink is hard to be discharged from the nozzles 110 and the ink discharging amount tends to be decreased.

Main factors for causing the change in pressure inherent to the case where the ink is supplied from the main tank 106 disposed out of the carriage 101 to the liquid discharge head through the tube 108 during the recording operation are (1) dynamic pressure of the tube, (2) pressure loss in the tube and (3) difference in posture.

Here, the "dynamic pressure of the tube" is a phenomenon that the tube 108 connected to the sub-tank 109 on the carriage 101 is vibrated as the carriage 101 is reciprocally shifted, with the result that inertia of the ink within the tube 108 acts to increase or decrease the pressure with respect to the sub-tank 109, which phenomenon is generated in accordance with acceleration/deceleration of the carriage and vibration due to such acceleration/deceleration.

Further, the "pressure loss in the tube" is flow resistance in the tube 108. If a consumed amount of ink due to ink discharging from the liquid discharge head becomes greater than the amount of ink supplied from the tube 108, the pressure in the sub-tank 109 will gradually be decreased, i.e., the negative pressure will be further increased. When an inner diameter of the tube 108 is sufficiently great, such a phenomenon is not noticeable, but, since the ink amount existing within the tube 108 is increased, the influence of the dynamic pressure of the tube tends to increase, contrary to the influence of the pressure loss in the tube.

Further, the "difference in posture" is inclination of the installed recording apparatus. If the recording apparatus is inclined with respect to the scanning direction of the carriage 101, since at both stroke ends of the reciprocating carriage 101, height of the carriage 101 with respect to the main tank, that is, height of the nozzles 110 is differentiated, change in pressure is generated due to difference in water head.

As countermeasure for such change in pressure, in the conventional image forming apparatuses, for example, as proposed in Japanese Patent Application Laid-open No. 1-281948 (1989), a fluidity suppressing member for suppressing fluidity of ink is added to each flow passage, or, as proposed in Japanese Patent Application Laid-open No. 5-201015 (1993), a sub-tank has a pressure dampening function as a pressure damper. In the image forming apparatus, in addition to consideration of such countermeasure, effort is generally made to provide a head in which use conditions mainly including a recording speed condition are stipulated to suppress the change in pressure within the sub-tank and to permit possible pressure change.

Further, as countermeasure for dampening the influence of the pressure change of the ink, it is considered that an open/close valve is provided in a flow passage between the main tank and the sub-tank so that the valve is opened to suppress the change of pressure within the tube during the recording operation and the valve is opened to supply the ink intermittently during a waiting condition.

However, in the above-mentioned countermeasure for the change in pressure, there were the following drawbacks.

That is to say, when the ink is supplied during the recording operation, since the apparatus is designed under the condition imposed regarding the pressure change, these are determined limits to the appearance quality of the recorded image and the discharging ability, so that abilities of constructural elements of the apparatus cannot be demonstrated adequately. Further, in the apparatus in which the open/close valve is closed to suppress the pressure change during the recording operation and the valve is opened to supply the ink during the waiting condition, since a continuous recording amount is determined by the volume of the sub-tank, the merit obtained by the design in which the ink is supplied from the main tank to the sub-tank through the tube cannot be sufficiently utilized.

SUMMARY OF THE INVENTION

An object of the present invention is to provide an image forming apparatus in which change in pressure within a sub-tank caused by dynamic pressure of a tube is selectively excluded and maximum ability can be achieved in accordance with an image forming condition to which the user desires.

Another object of the present invention is to provide an image forming apparatus for forming an image by discharging liquid from a recording head onto a recording medium, comprising a carriage to which the recording head and a sub-tank for storing the liquid to be supplied to the recording head are mounted and which can be shifted reciprocally, a main tank disposed out of the carriage and adapted to store the liquid, a liquid flow passage connected between the main tank and the sub-tank in order to supply the liquid from the main tank to the sub-tank, a flow passage opening/closing valve disposed in the liquid flow passage on the way and adapted to open and close the liquid flow passage, and control means for controlling opening/closing of the flow passage opening/closing valve in accordance with an image forming condition during image forming using the recording head.

DESCRIPTION OF THE PREFERRED EMBODIMENTS

The present invention will now be explained in connection with embodiments thereof with reference to the accompanying drawings.

Figure 1:
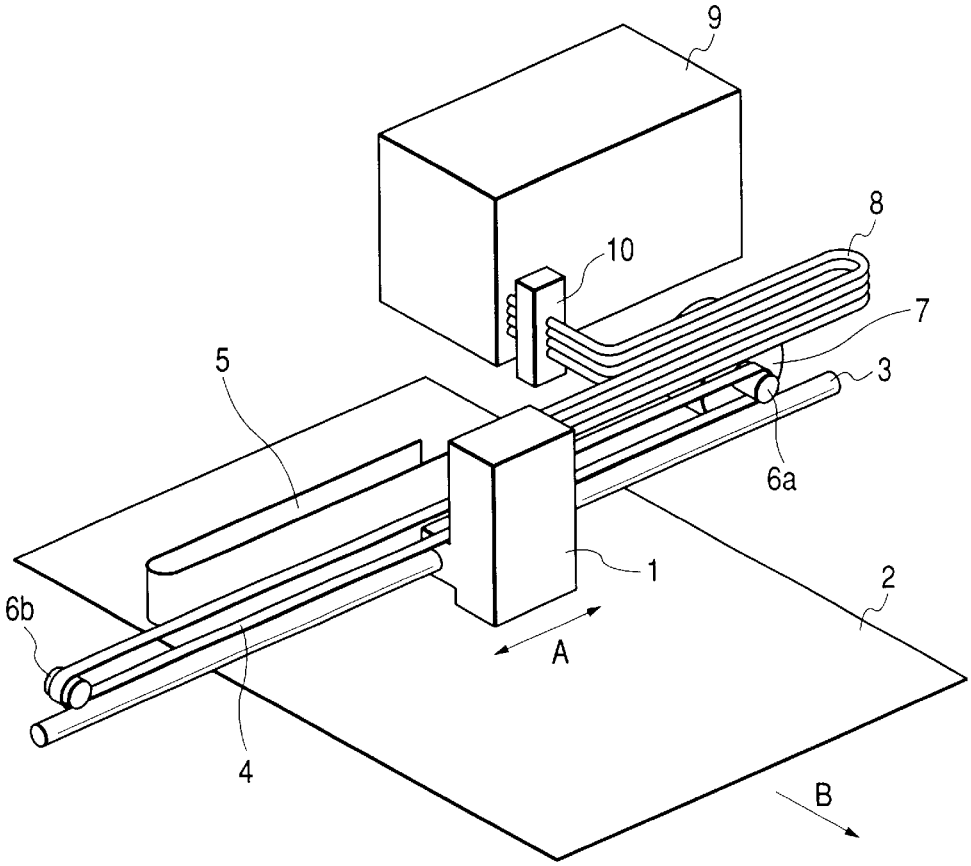
FIG. 1 is a schematic constructural view showing an image forming apparatus according to an embodiment of the present invention.

FIG. 1 is a schematic constructural view showing an image forming apparatus according to an embodiment of the present invention.

Figure 6:
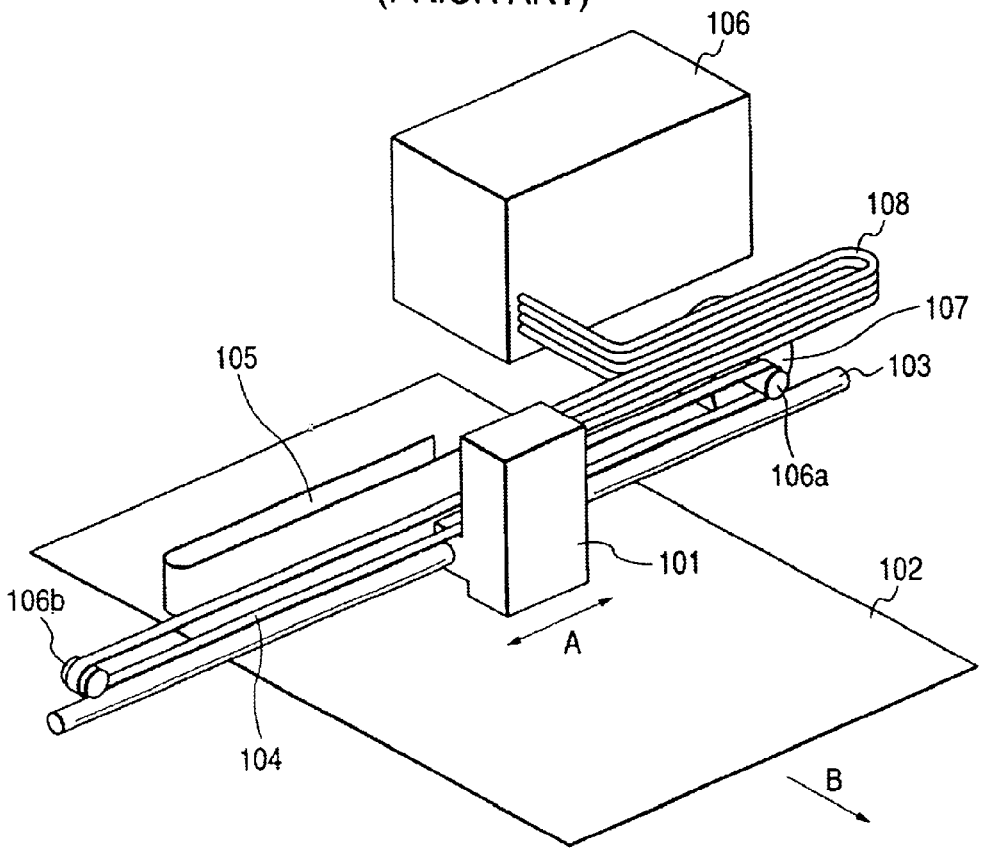
FIG. 6 (PRIOR ART)
FIG. 6 is a schematic constructural view of a conventional ink jet recording apparatus designed to have an ink tank disposed out of a carriage.
Figure 7:
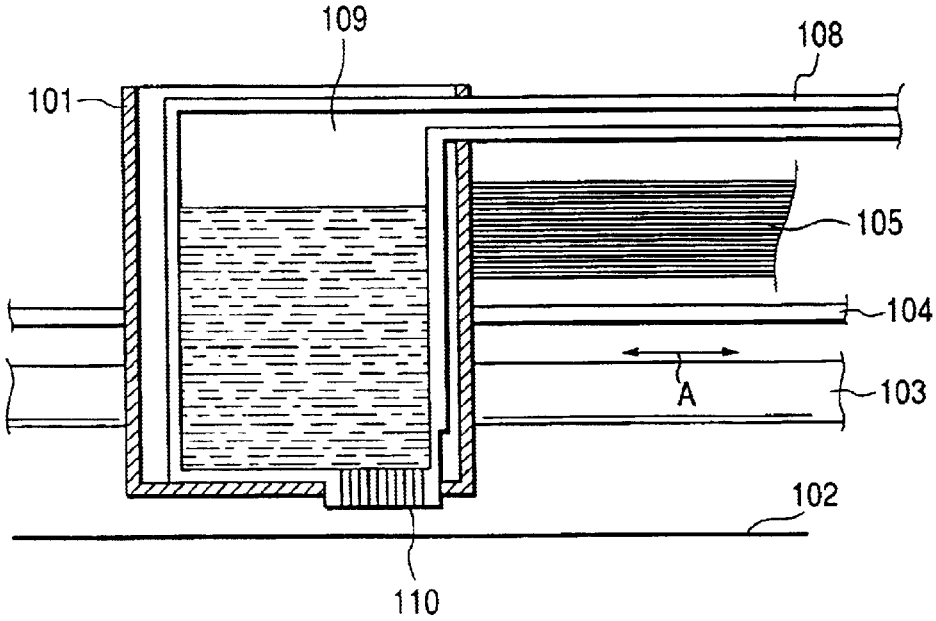
FIG. 7 (PRIOR ART)
FIG. 7 is a sectional view showing an internal construction of the carriage shown in FIG. 6.

Similar to the apparatus shown in FIGS. 6 and 7, the image forming apparatus according to the illustrated embodiment comprises a carriage 1 on which a liquid discharge head (not shown) for forming an image by discharging liquid such as ink onto a recording medium 2 and a sub-tank (not shown) for storing the ink to be supplied to the head are mounted, a belt 4 a part of which is secured to the carriage 1 and which is wound around two pulleys 6*a* and 6*b*, a motor 7 for rotatingly driving one 6*a* of the pulleys reversibly, and a cable 5 for inputting a signal and an electric power for causing the liquid discharge head to discharge the ink, from control means (not shown) of the image forming apparatus to the liquid discharge head. The carriage 1 is reciprocally shifted in directions A along a shaft 103 by shifting the belt 4 by rotatingly driving the pulley 6*a* reversibly by means of the motor 107.

The image forming apparatus includes convey means (not shown) for conveying a recording medium 2 in a direction B, and the image is formed on the entire recording medium 2 by repeating a conveying operation for the recording medium 2 effected by the convey means and an image forming operation effected by the liquid discharge head mounted on the carriage reciprocally shifting with respect to the recording medium 2.

Further, a main tank 9 is disposed out of the carriage 1, and the ink is supplied from the main tank to the sub-tank on the carriage 1 via a tube 8. Further, a flow passage opening/closing valve 10 for opening and closing a liquid passage within the tube 8 is provided on the way of the tube 8 connecting between the main tank 9 and the sub-tank mounted on the carriage 1. Further, the image forming apparatus includes control means (not shown) for controlling the opening/closing of the flow passage opening/closing valve 10.

Incidentally, for example, the flow passage opening/closing valve 10 may be an electromagnetic valve capable of being switched between an opening condition and a closing condition. Pressure in the sub-tank is set to be within a negative pressure range which permits the discharging of the ink statically both in an opened condition and a closed condition of the flow passage opening/closing valve 10 so long as the amount of the reserved ink is proper.

(First Embodiment)

Figure 2:
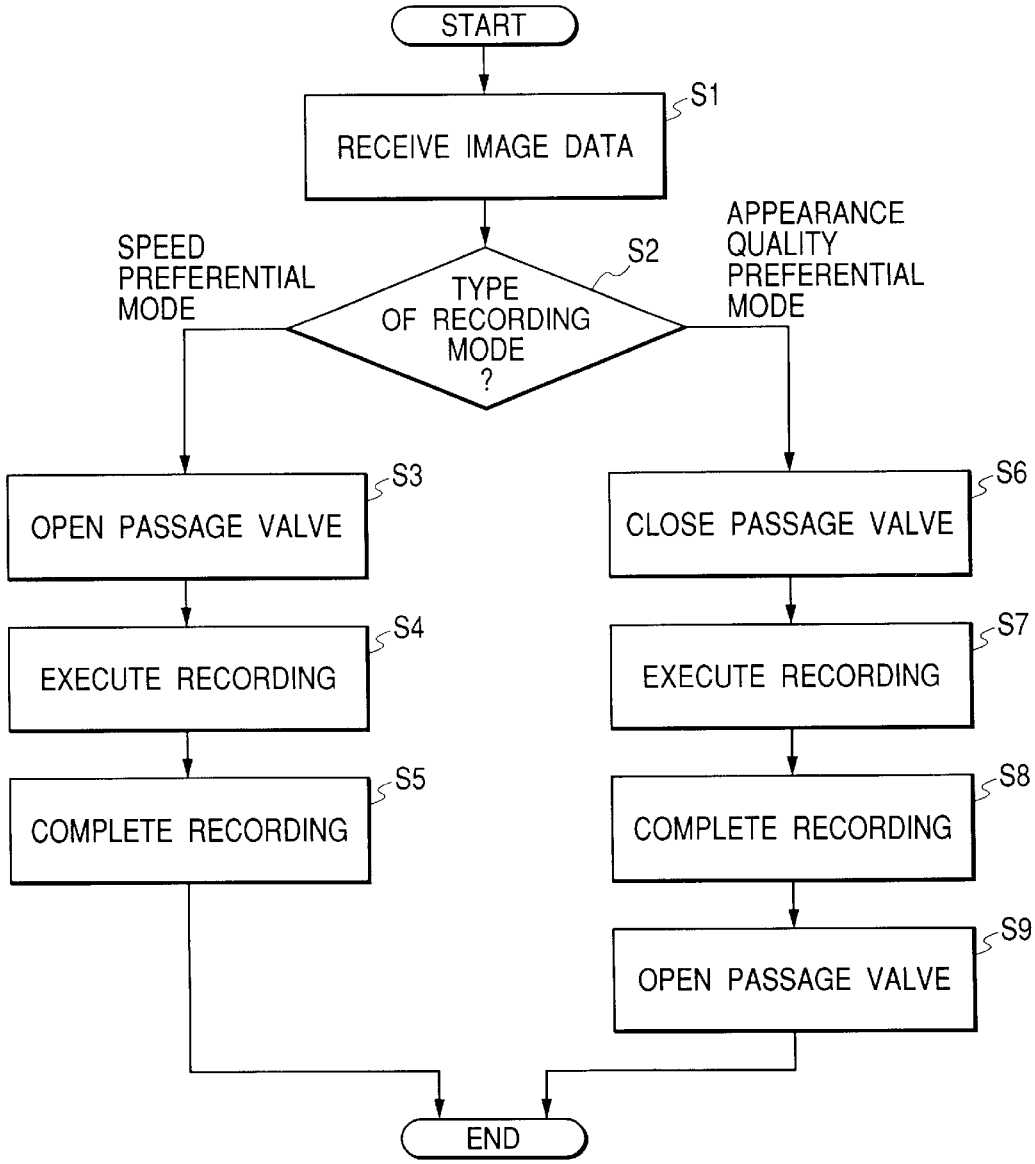
FIG. 2 is a flow chart for explaining a controlling operation of the image forming apparatus according to the present invention.

FIG. 2 is a flow chart showing a first embodiment of an image forming apparatus according to a first embodiment.

When the control means (not shown) of the image forming apparatus receives image data from an information equipment (not shown) as an external device for the image forming apparatus (step S1), the control means judges whether a recording mode of the image data is an "appearance quality preferential mode" or a "speed preferential mode" (step S2). For example, such judgement is effected on the basis of information regarding an image forming condition included in the image data sent from the external information equipment (not shown).

If the recording mode is the "speed preferential mode" which allows to generate distortion of the appearance quality of the recorded image due to the pressure change of the ink, i.e., if the appearance quality of the recorded image is lower than a predetermined appearance quality, the flow passage opening/closing valve is opened (step S3) and the recording is executed continuously (step S4). After the recording is completed (step S5), the flow passage opening/closing valve is maintained to the opened condition.

On the other hand, if the recording mode is the "appearance quality preferential mode", i.e., if the appearance quality of the recorded image is higher than the predetermined appearance quality, the flow passage opening/closing valve is closed to suppress the pressure change of the ink during the recording operation (step S6), and the recording is executed in such a condition (step S7). After the recording is completed (step S8), the flow passage opening/closing valve is opened (step S9), thereby supplying the ink from the main tank to the sub-tank.

In this way, by controlling the opening/closing of the flow passage opening/closing valve 10 depending upon whether the recording mode of the recording information is the "appearance quality preferential mode" or the "speed preferential mode", the recording operation of the image forming apparatus can be optimized in accordance with the user's desire.

(Second Embodiment)

Figure 3:
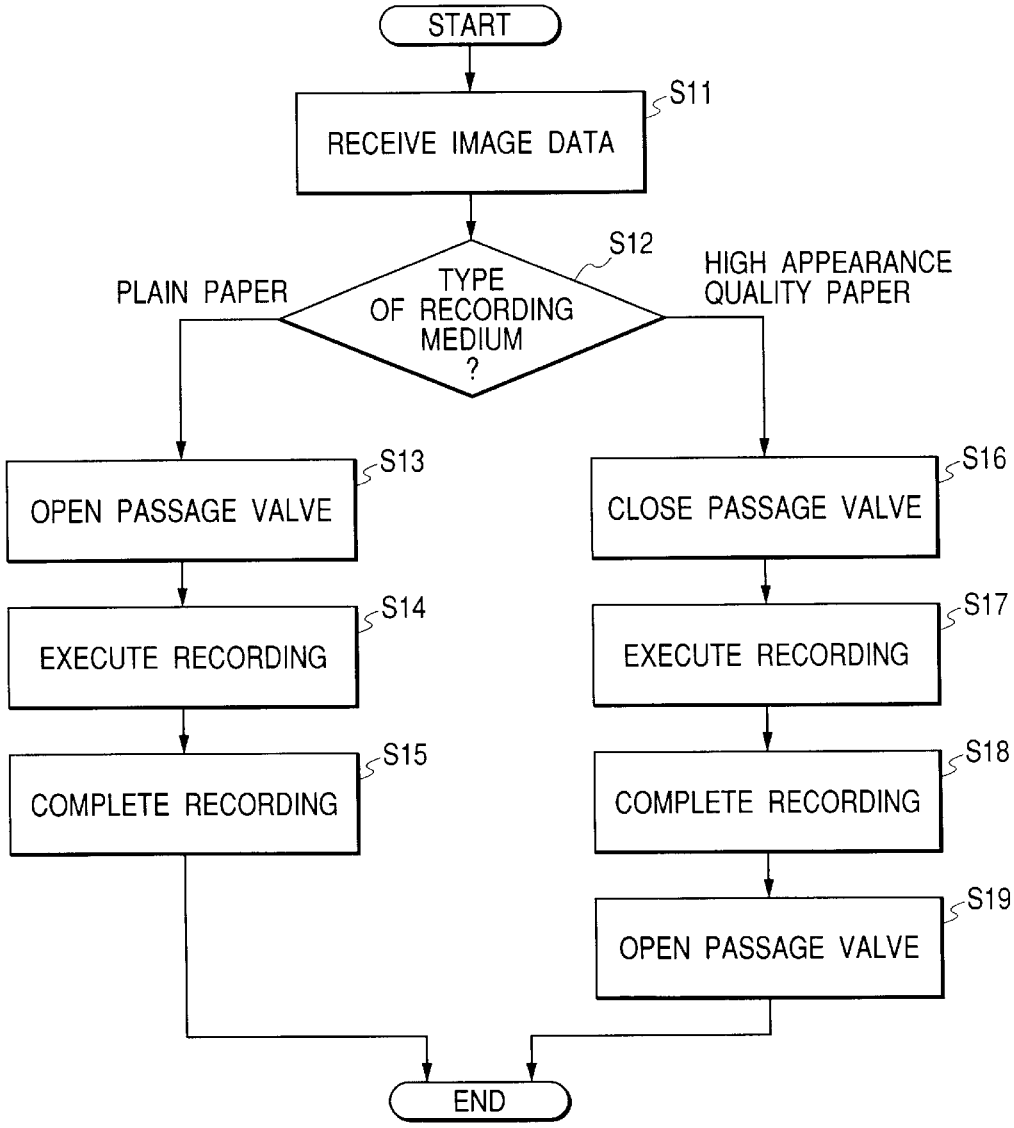
FIG. 3 is a flow chart for explaining another controlling operation of the image forming apparatus according to the present invention.

FIG. 3 is a flow chart showing a second embodiment of an image forming apparatus according to the present invention.

When the control means (not shown) of the image forming apparatus receives image data from an information equipment (not shown) as an external device for the image forming apparatus (step S11), the control means judges whether a recording medium on which the image data is to be recorded is a high appearance quality paper or a plain paper (step S12).

If the recording medium on which the recording is executed is the plain paper or the like which allows to generate distortion of the appearance quality of the recorded image due to the pressure change of the ink, i.e., if the recording medium is not a recording medium on which an image having appearance quality higher than a predetermined appearance quality is recorded, the flow passage opening/closing valve is opened (step S13) and the recording is executed continuously (step S14). After the recording is completed (step S15), the flow passage opening/closing valve is maintained to the opened condition.

On the other hand, if the recording medium on which the recording is executed is the high appearance quality paper, i.e., if the recording medium is a recording medium on which an image having appearance quality higher than a predetermined appearance quality is recorded, the flow passage opening/closing valve is closed to suppress the pressure change of the ink during the recording operation (step S16), and the recording is executed in such a condition (step S17). After the recording is completed (step S18), the flow passage opening/closing valve is opened (step S19), thereby supplying the ink from the main tank to the sub-tank.

Incidentally, for example, the judgement regarding the recording medium is effected on the basis of information regarding the recording medium included in the image data sent from the information equipment (not shown) or is effected by discriminating the kind of the recording medium set in the image forming apparatus by means of a medium discriminating sensor provided in the image forming apparatus.

In this way, in the illustrated embodiment, by controlling the opening/closing of the flow passage opening/closing valve in accordance with the recording medium on which the recording is executed, the recording operation of the image forming apparatus can be optimized in accordance with the user's desire.

(Third Embodiment)

Figure 4:
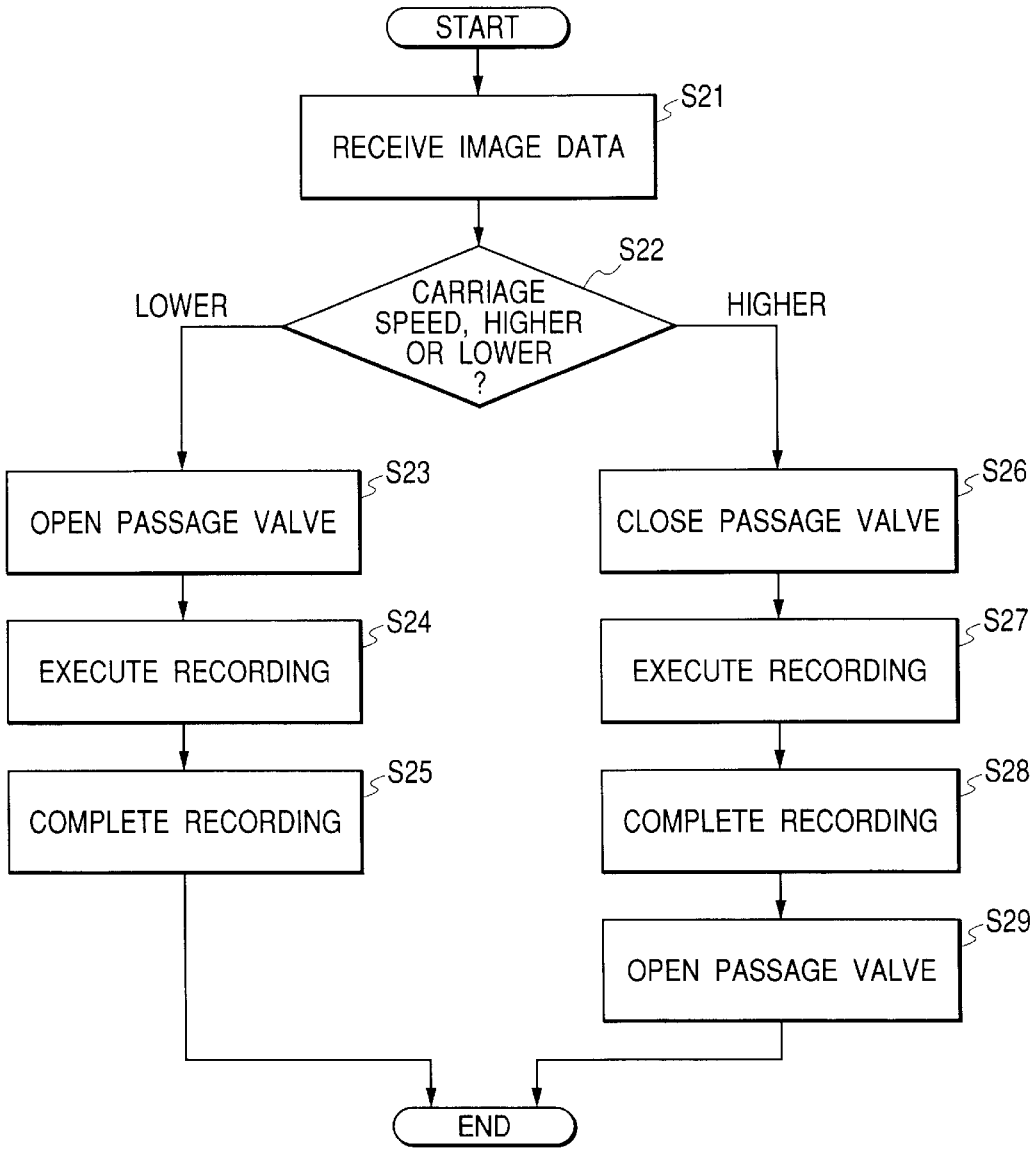
FIG. 4 is a flow chart for explaining a further controlling operation of the image forming apparatus according to the present invention.
Figure 5:
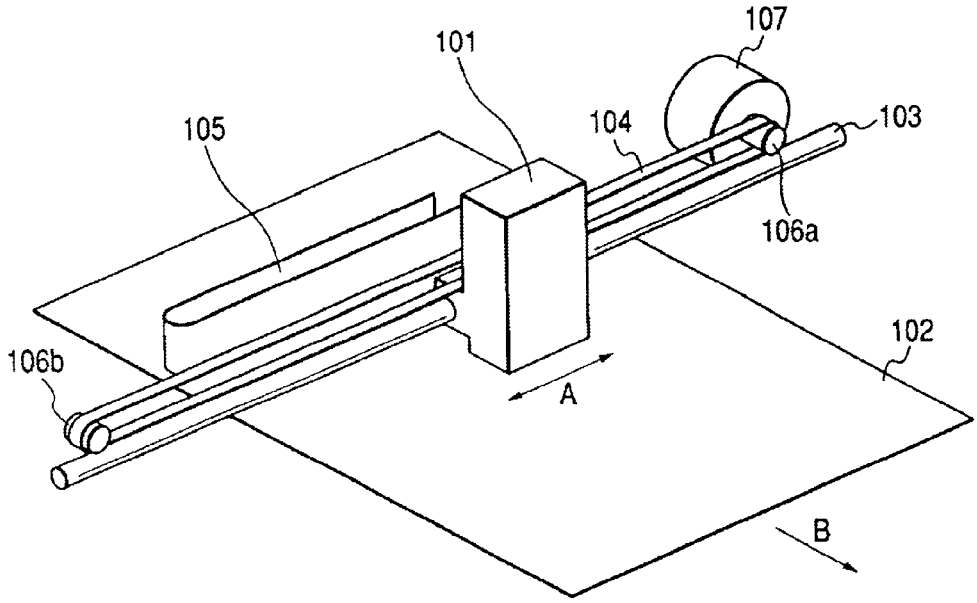
FIG. 5 (PRIOR ART)
FIG. 5 is a schematic constructural view of a conventional ink jet recording apparatus designed to have an ink tank on a carriage.

FIG. 4 is a flow chart showing a third embodiment of an image forming apparatus according to the present invention.

When the control means (not shown) of the image forming apparatus receives image data from an information equipment (not shown) as an external device for the image forming apparatus (step S21), the control means judges or determines a shifting speed of the carriage corresponding to a recording mode for recording the image data (step S22).

If the shifting speed of the carriage is smaller than a predetermined speed, the flow passage opening/closing valve is opened (step S23) and the recording is executed continuously (step S24). After the recording is completed (step S25), the flow passage opening/closing valve is maintained to the opened condition. Incidentally, if the shifting speed of the carriage is smaller than the predetermined speed, distortion of the recording appearance quality caused by the pressure change of the ink becomes to the extent which can be allowed.

On the other hand, if the shifting speed of the carriage is greater than the predetermined speed, the flow passage opening/closing valve is closed to suppress the pressure change of the ink during the recording operation (step S26), and the recording is executed in such a condition (step S27). If the shifting speed of the carriage is greater than the predetermined speed, although the pressure change of the ink affecting an influence upon the recording appearance quality is generated, by closing the flow passage opening/closing valve during the recording operation as mentioned above, such an influence can be suppressed. After the recording is completed (step S28), the flow passage opening/closing valve is opened (step S29), thereby supplying the ink from the main tank to the sub-tank.

In this way, according to the illustrated embodiment, by controlling the opening/closing of the flow passage opening/closing valve in accordance with the shifting speed of the carriage during the recording operation, the recording operation of the image forming apparatus can be optimized in accordance with the user's desire.

As mentioned above, in the image forming apparatus according to the present invention, since the flow passage opening/closing valve for opening and closing the liquid flow passage is provided on the way of the liquid flow passage and the opening/closing of the liquid flow passage during the image forming operation effected by the liquid discharge head is controlled in accordance with the image forming conditions, the change in pressure within the sub-tank due to the dynamic pressure of the tube can selectively be excluded, and the ability of the image forming apparatus can be achieved at the maximum in accordance with the image forming condition to which the user desire.

What is claimed is:

1. An image forming apparatus for forming an image by discharging liquid from a recording head onto a recording medium, comprising:

a carriage to which said recording head and a sub-tank for storing the liquid to be supplied to said recording head are mounted and which can be shifted reciprocally;

a main tank disposed out of said carriage and adapted to store the liquid;

a liquid flow passage connected between said main tank and said sub-tank in order to supply the liquid from said main tank to said sub-tank;

a flow passage opening/closing valve disposed in said liquid flow passage on the way and adapted to open and close said liquid flow passage; and a control means for controlling opening/closing of said flow passage opening/closing valve in accordance with an image forming condition during image forming using said recording head.

2. An image forming apparatus according to claim 1, wherein the image forming condition is an appearance quality of the image recorded on the recording medium.

3. An image forming apparatus according to claim 2, wherein said flow passage opening/closing valve is controlled to be closed when the appearance quality of the image is higher than a predetermined appearance quality, and opened when the appearance quality of the image is lower than the predetermined appearance quality.

4. An image forming apparatus according to claim 1, wherein the image forming condition is the kind of the recording medium on which the image is recorded.

5. An image forming apparatus according to claim 4, wherein said flow passage opening/closing valve is controlled to be closed when the recording medium is a recording medium on which an image having an appearance quality higher than a predetermined appearance quality is recorded, and opened when the recording medium is a recording medium on which an image having an appearance quality lower than the predetermined appearance quality is recorded.

6. An image forming apparatus according to claim 4, further comprising a medium discriminating sensor for discriminating the kind of the recording medium.

7. An image forming apparatus according to claim 1, wherein the image forming condition is a shifting speed of said carriage.

8. An image forming apparatus according to claim 7, wherein said flow passage opening/closing valve is controlled to be closed when the shifting speed of said carriage is greater than a predetermined speed, and opened when the shifting speed of said carriage is smaller than the predetermined speed.

9. An image forming apparatus according to claim 1, wherein image data inputted to said image forming apparatus from exterior includes information regarding the image forming condition, and the information regarding the image forming condition is obtained from the image data.

* * * * *

UNITED STATES PATENT AND TRADEMARK OFFICE

CERTIFICATE OF CORRECTION

PATENT NO. : 6,685,308 B2
DATED : February 3, 2004
INVENTOR(S) : Masahito Yoshida et al.

It is certified that error appears in the above-identified patent and that said Letters Patent is hereby corrected as shown below:

Title page,
Item [75], Inventors, "Noriko Sato, Kanagawa (JP)" should read -- Noriko Sato, Tokyo (JP). --

Column 1,
Line 45, "kind" should read -- the kind --.

Column 7,
Line 4, "desire" should read -- desires --.

Signed and Sealed this

Fifth Day of October, 2004

JON W. DUDAS
*Director of the United States Patent and Trademark Office*